US006295925B1

(12) United States Patent
Sarni et al.

(10) Patent No.: US 6,295,925 B1
(45) Date of Patent: Oct. 2, 2001

(54) WEB TENSION CONTROL SYSTEM AND METHOD FOR FLEXOGRAPHIC TAG AND LABEL PRESSES

(75) Inventors: Michael P. Sarni, Trumbull; Peter A. Bria, Stamford, both of CT (US)

(73) Assignee: Sarni/Bria Flexographic LLC, Monroe, CT (US)

( * ) Notice: Subject to any disclaimer, the term of this patent is extended or adjusted under 35 U.S.C. 154(b) by 0 days.

(21) Appl. No.: 09/575,583

(22) Filed: May 22, 2000

(51) Int. Cl.[7] ..... B41F 13/54

(52) U.S. Cl. ..... 101/228; 101/DIG. 42

(58) Field of Search ..... 101/178, 181, 101/216, 217, 218, 219, 227, 228, 231, 484, 485, DIG. 42; 226/34, 35, 38, 193, 195

(56) References Cited

U.S. PATENT DOCUMENTS

| | | | | |
|---|---|---|---|---|
| 4,722,275 | * | 2/1988 | Taguchi et al. | 101/228 |
| 4,878,427 | | 11/1989 | Washchysnky et al. . | |
| 5,438,926 | * | 8/1995 | Hudyma et al. | 101/227 |
| 5,490,461 | * | 2/1996 | Beaudoin | 101/219 |
| 5,511,712 | * | 4/1996 | Holm et al. | 101/228 |
| 5,636,567 | | 6/1997 | Mucha et al. . | |
| 5,806,418 | | 9/1998 | Dillinger . | |
| 5,904,094 | * | 5/1999 | Bredenberg | 101/216 |

OTHER PUBLICATIONS

Roto Press International product line specification sheet for 3500 PF "Primeflex" Series, 3500 VF "Versaflex" Series, 6000 EF "Econoflex" Series and 6500 EC "Econoflex 16" Series.

Roto Press International product specification sheet for VersaFlex Models 3510 & 3513, Aug., 1998.

Webtron Performance Presses 1000, 1013, 1618 & 1620 product specification brochure, Copyright 1994, 3 pages.

Webtron Tag & Label Press 750 HQV product specification brochure, Copyright 1994, 3 pages.

* cited by examiner

*Primary Examiner*—Ren Yan
(74) *Attorney, Agent, or Firm*—Ware, Fressola, Van der Sluys & Adolphson LLP

(57) ABSTRACT

In a flexographic tag and label press, a mid-driven infeed tension controlling system is installed between the printing/drying section and the converting section of the press. By creating two separate tension zones, one for printing and one for converting, the mid-driven infeed tension controlling system improves color to color registration in steady state run tolerances, improves make ready times and waste factors, and improves the register of products upon the starts and stops of the press as well as facilitating roll changes and random material roll splices.

48 Claims, 5 Drawing Sheets

WEB TENSION CONTROL SYSTEM AND METHOD FOR FLEXOGRAPHIC TAG AND LABEL PRESSES

BACKGROUND OF THE INVENTION

1. Technical Field

The present invention relates generally to flexography and, more particularly, it relates to a method and apparatus for mid-driven infeed for Webtron Model 650 and 750 flexographic printing presses.

2. Description of the Background Art

In the flexographic printing field, a typical flexographic web-fed tag and label press has several sections which are (1) the unwind and infeed section; (2) the printing and drying section; (3) the die-cutting or converting section; and (4) the rewind section. Variations and additions to these sections allow such presses to be adaptable to many different in-line operations.

Two known flexographic web-fed tag and label presses are the Webtron Model 650 and 750 presses made by the Webtron Corporation, 2030 W. McNab Road, Fort Lauderdale, Fla. 33309. In general, these presses have (1) an infeed tension control which isolates the unwinding/infeed section from the printing/drying and converting sections and (2) a total tension zone for both the printing/drying and converting sections thereof. In these presses, proper tension on the web is important to prevent slack, wrinkles, stretch and/or breakage as well as creating proper registration. However, since such tension is created in the converting section and the rewind section, it is difficult to maintain accurate overall tension and registration upstream in the printing/drying section of these presses.

SUMMARY OF THE INVENTION

The present invention is designed to overcome the above limitations that are attendant upon the use of known tag and label presses, and toward this end, it contemplates the provision of a novel method and apparatus for providing for mid-driven infeed for Webtron Model 650 and 750 flexographic printing presses.

It is an object of the present invention to provide a retrofitable attachment which tensionally isolates the printing/drying section from the converting section of the press.

A further object is to provide an apparatus that is compatible with conventional Webtron Model 650 and 750 presses and is generally compatible in physical size, form and configuration with such presses, to be readily adaptable for the same use without disadvantage.

It is a general aim of the invention to provide such an apparatus which may be readily and economically fabricated and will have long life in operation and significantly greater flexibility in use.

It has now been found that the foregoing and related objects can be readily attained in a method and apparatus in accordance with the present invention which utilizes a retrofitable mid-driven infeed unit to control the tension of the web material in the printing/drying section of the flexographic tag and label press.

According to the invention, a flexographic tag and label press for processing a web material following a web path therethrough has a printing/drying section in the web path for providing color on the web material and a converting section in the web path downstream of the printing/drying section for cutting the web material to form tags or labels.

The converting section has a driven mechanism which is connected to a mid-driven infeed tension control apparatus in the web path between the printing/drying section and the converting section for use in controlling tension in the web material passing through the printing/drying section.

The mid-driven infeed tension control apparatus has a driving mechanism drivingly engaged by the driven mechanism of the converting section, a pacing roll, a nip roll and an idler roll. The pacing roll is rotatable about an axis and drivingly engaged by the driving mechanism to rotate the pacing roll. The nip roll is rotatable about an axis substantially parallel to the axis of the pacing roll and is adjacent the pacing roll to create a nip therewith through which the web material passes. The nip roll and the pacing roll cooperate to exert a force on the web material passing through the nip. A mechanism is provided to adjust the force on the web material passing through the nip and thus control tension in the web material passing through the printing/drying section. The idler roll is spaced from the nip for guiding the web material into the nip point.

Conveniently, the driving mechanism has a gear adjustably adapted to be drivingly engaged by the driven mechanism of the converting section. The driving mechanism can be a swing gear assembly which includes a swing gear mounted on a swing gear mounting plate. The swing gear mounting plate is adapted to be adjusted to move the swing gear into driving engagement with the driven mechanism of the converting section. The driving mechanism can also include a pacing roll gear mounted on an end of the pacing roll about the axis thereof as well as an intermediate drive gear between the pacing roll gear and the driven mechanism of the converting section.

Ideally, one of the nip roll and the pacing roll has a resilient outer surface for engaging the web material. The other of the nip roll and the pacing roll has a friction finish on an outer surface thereof for engaging the web material.

According to the invention, the mechanism to adjust the force on the web material passing through the nip relatively moves the nip roll and the pacing roll. The force adjusting mechanism includes at least one pneumatically actuated cylinder for moving the nip roll. Air pressure to the at least one pneumatically actuated cylinder can be varied to adjust the force on the web material passing through the nip thus controlling tension in the web material passing through the printing/drying section.

In a further feature of the invention, a pair of spaced apart support plates are provided to which the pacing roll and the nip roll are rotatably mounted. At least one of the pair of spaced apart support plates is mounted adjacent the converting section. In addition, at least a portion of the driving mechanism drivingly engaged by the driven mechanism of the converting section is mounted on one of the pair of spaced apart support plates.

The invention will be fully understood when reference is made to the following detailed description taken in conjunction with the accompanying drawings.

DETAILED DESCRIPTION OF THE INVENTION

Figure 1:
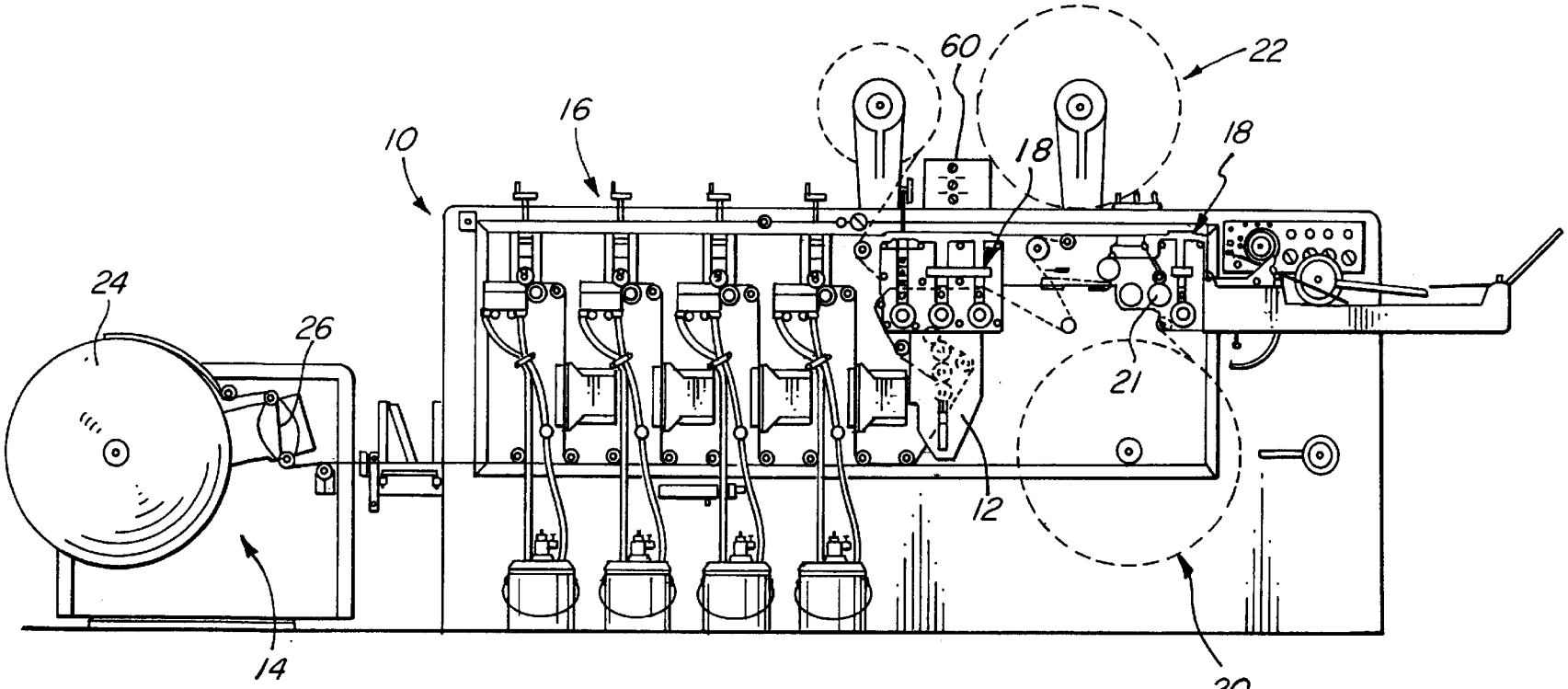
FIG. 1 is a schematic front elevational view of a Webtron Model 650 or 750 flexographic web-fed tag and label press utilizing the mid-driven infeed tension controlling system of the present invention.

Turning first to FIG. 1 of the drawings, therein illustrated is a flexographic tag and label press which is generally designated by the numeral 10 on which is incorporated a aid-driven infeed tension controlling system 12 made in accordance with the present invention. The flexographic tag and label press 10 can be either a Webtron Model 650 press or a Webtron Model 750 press made by the Webtron Corporation, 2030 W. McNab Road, Fort Lauderdale, Fla. 33309. The main functional difference between these presses is that one can print a maximum width of 6½" while the other can print a maximum width of 7½". Such presses are very well known in the art so the structure and function thereof will be not be explained in detail.

The flexographic tag and label press 10 has unwinding/infeed section generally indicated by the numeral 14, a printing/drying section generally indicated by the numeral 16, a converting section generally indicated by the numeral 18, a product rewind section generally indicated by the numeral 20 and a waste rewind section generally indicated by the numeral 22. The unwinding/infeed section 14 has roll 24 of web material 26 which is typically pressure sensitive adhesive backed material on a releaseable base film material. The web material 26 proceeds through a number of printing and drying stations in the printing/drying section 16 where different colors are printed on the web material 26 to produce full color printed labels or tags. Various stations in the converting section 18 can be utilized to die cut, crease, perforate, laminate, etc. thereby producing finished tag or label products on the releasable base film material which is wound up in the product rewind section 20. Waste material is wound up in the waste rewind section 22.

The tension necessary to pull the web material 26 through the flexographic tag and label press 10 has been up to this point created by an outfeed pull roll 21 in the converting section 18. However, because of the circuitous path which the web material 26 follows through the flexographic tag and label press 10, particularly through the printing/drying section 16, it is very difficult to maintain an even tension and thus proper registration through the various printing stations. Proper registration is important so that various colors will be printed in the proper positions on the web material 26. To help maintain the desired even tension through the printing/drying section 16, the present invention involves the mounting of the mid-driven infeed tension controlling system 12 between the printing/drying section 16 and the converting section 18.

Referring now to FIGS. 2–5, the mid-driven infeed tension controlling system 12 is a discrete retrofitable unit which can be bolted to either the Webtron Model 650 or Webtron Model 750 adjacent the converting section 18, preferably underneath the existing die cutting station. The mid-driven infeed tension controlling system 12 has front and rear aluminum support plates 28, 30 which are spaced apart by an upper and lower support rods 32, 34 secured on each end to the support plates 28, 30 by machine screws 36. The rear support plate 30 is bolted to the flexographic tag and label press 10. Each support plate 28 and 30 has a rectangular aperture 37 into which is fit a pneumatic cylinder 38 made by Bimba Manufacturing Company of Monee, Ill. The cylinder end of the pneumatic cylinder 38 is connected to its respective support plate by a machine screw 40 while the rod end of the pneumatic cylinder 38 is connected to a nip roll shaft support clevis assembly 42 slidably mounted within a nip roll mounting bracket 44. The nip roll mounting bracket 44 is secured to its respective support plate by machine screws 46. Mounted between the nip roll shaft support clevis assemblies 42 is a nip roll support shaft 47 on which a rubber nip roll 48 is rotatably mounted. The nip roll 48 has a steel core laminated with buna-n rubber. The nip roll 48 is rotatably mounted on the nip roll shaft 47 by bearings (not shown) through which the nip roll support shaft 47 is pressed into place. A pair of snap rings (not shown) on either end of nip roll shaft 47 adjacent the bearings lock the nip roll 48 in a final position on the nip roll shaft 47. Thus, the nip roll 48 can rotate on the nip roll support shaft 47 which in turn can slide along with the nip roll shaft support clevis assemblies 42 in the nip roll mounting brackets 44 as illustrated by arrow 49 in FIG. 4.

Figure 5:
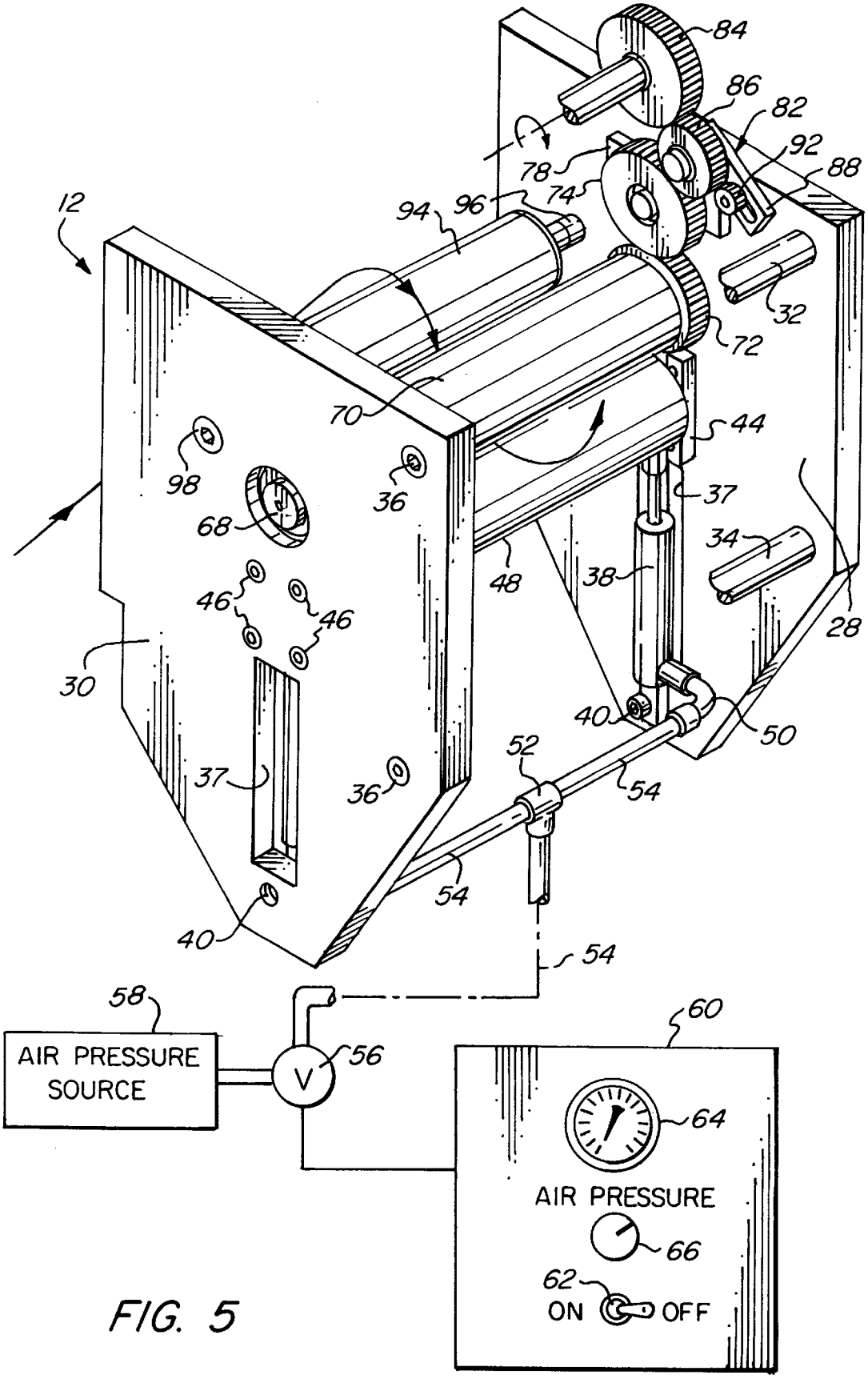
FIG. 5 is a perspective view of the mid-driven infeed tension controlling system of the present invention shown drivingly connected to the middle lower base roll gear of the flexographic web-fed tag and label press and schematically illustrating the air pressure control system therefor.

As best seen in FIG. 5, air pressure can introduced to the pneumatic cylinders 38 in a controlled manner by ninety degree (90°) ¼" air fittings 50, T shaped ¼" air fitting 52, air supply lines 54, valve 56, air pressure source 58 and control box 60. The control box 60 includes an on/off switch 62, a pressure gauge 64 and a pressure regulator dial 66 and can be mounted on the flexographic tag and label press 10 as shown in FIG. 1 for the purpose to be explained further hereinafter.

Rotatably mounted above the nip roll 48 by sealed ball bearings 68 in the front and rear support plates 28, 30 is a friction coated pacing roll 70 having a gear 72 adjacent the rear support plate 30. The friction coated pacing roll 70 can be made of steel with a sand blasted outer surface or plasma coated outer surface having a specific diameter. The gear 72 is operationally connected to a intermediate drive gear 74 which is rotatably cantilevered from the front support plate 28 utilizing an intermediate gear bearing 76 mounted on a cross support bar 78 secured to the front support plate 28 via machine screws 80. A swing gear assembly generally indicated by the numeral 82 is provided to drivingly connect the mid-driven infeed tension controlling system 12 to the flexographic tag and label press 10 via a middle lower base roll gear 84 in the converting section 18, preferably at the second die cutting station. The swing gear assembly 82 has a swing gear 86 rotatably mounted on a swing gear mounting plate 88 having a slot 90 therein for adjustably securing the swing gear mounting plate 88 to the front support plate 28 using a swing gear mounting screw 92. This three gear drive system is designed to match the pitch configuration of the middle lower base roll gear 84. The most common gearing configurations used are ⅛ inch-64 tooth 20 degree C.P. (circular pitch angle), ⅛ inch-63 tooth 20 degree C.P. and 32 D.P. (diametrel pitch). All the gears are made from a steel material. As will be appreciated by those skilled in the art, the finished diameter of the friction coated pacing roll 70 is determined by the gear pitch diameter of the flexographic tag and label press 10.

To correctly position the web material 26 to enter the nip defined between the nip roll 48 and the friction coated pacing roll 70, an idler roll 94 is rotatably mounted on a support shaft 96 by idler bearings (not shown). The support shaft 96 is held in place by machine screws 98 to the front and rear support plates 28, 30. The idler roll 94 is located adjacent the friction coated pacing roll 70. The idler roll 94 can be made from aluminum.

Figure 2:
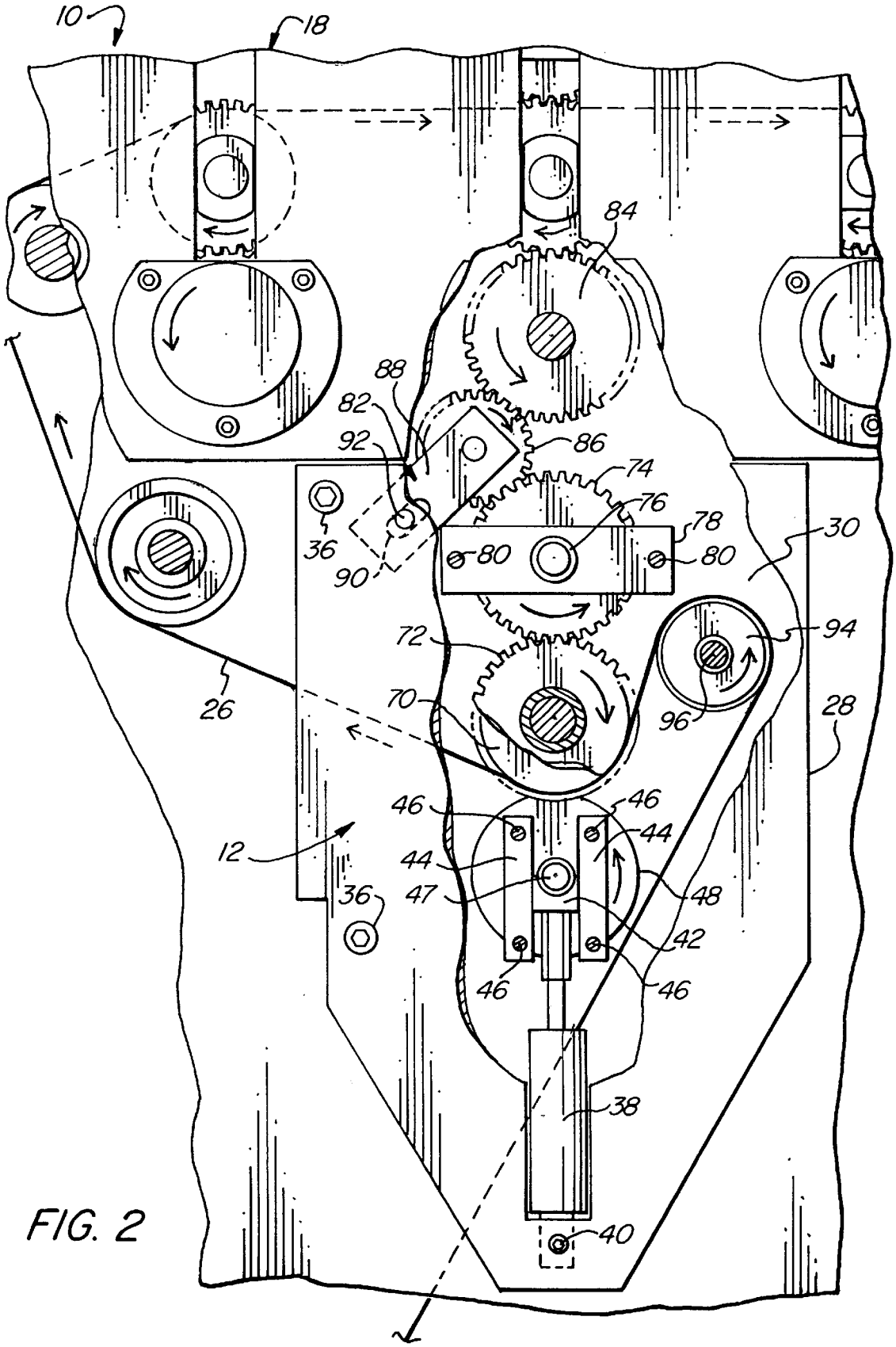
FIG. 2 is a front elevational view of a portion of the flexographic web-fed tag and label press of FIG. 1 showing the mid-driven infeed tension controlling system of the present invention with portions of one of the pair of support plates and various other components broken away to show the structure therebehind.
Figure 3:
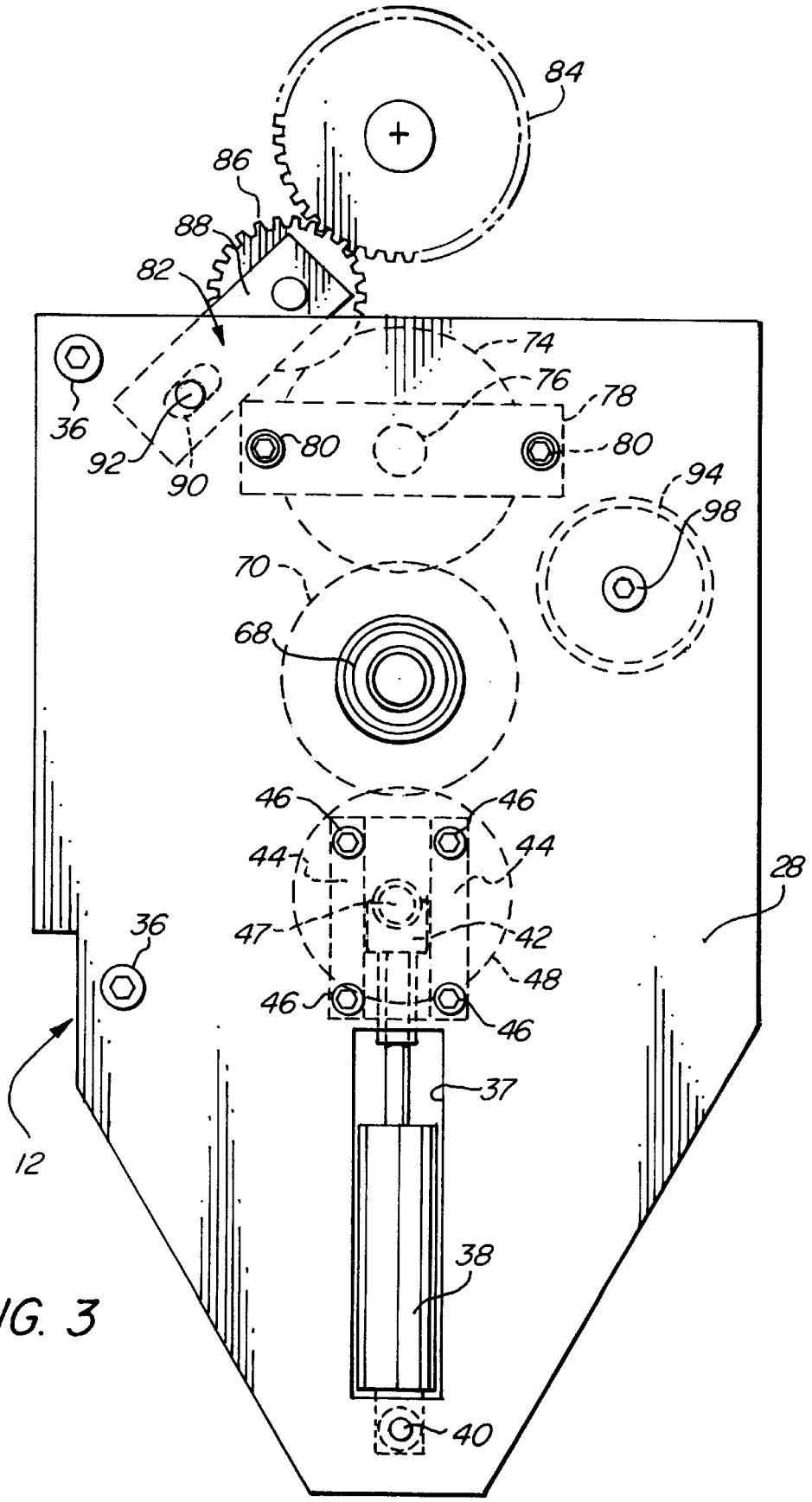
FIG. 3 is a front elevational view of the mid-driven infeed tension controlling system of the present invention shown drivingly connected to the middle lower base roll gear of the flexographic web-fed tag and label press.
Figure 4:
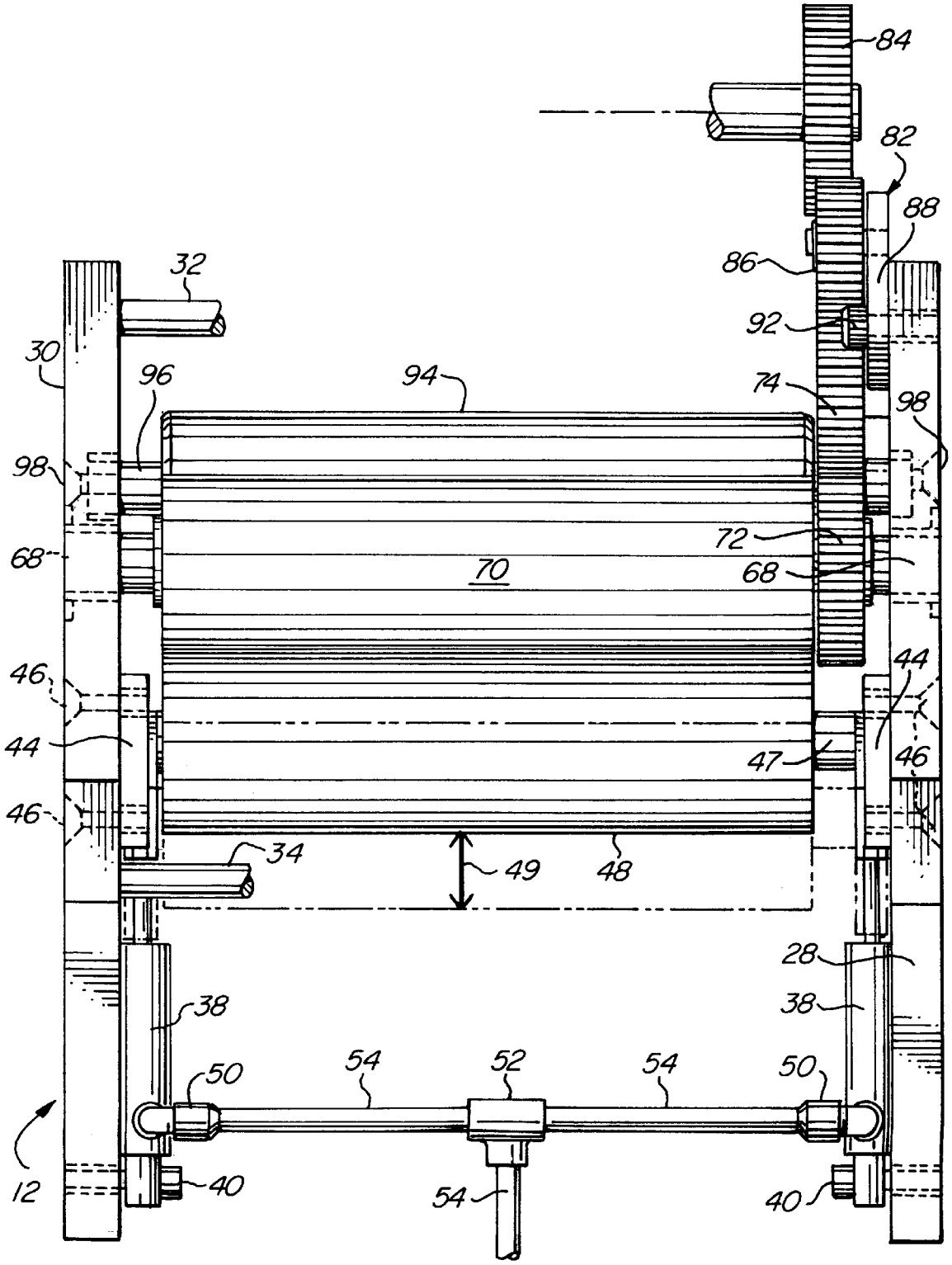
FIG. 4 is a right side elevational view of the mid-driven infeed tension controlling system of the present invention shown drivingly connected to the middle lower base roll gear of the flexographic web-fed tag and label press.

The operation of the invention can be best understood from FIGS. 1 and 2. The web material 26 coming along the web path from the printing/drying section 16 extends over the idler roll 94 and through the nip created between the nip roll 48 and the friction coated pacing roll 70. Tension on the web material 26 through the printing/drying section 16 is then essentially controlled by the mid-driven infeed tension controlling system 12. The user can adjust the tension on the web material 26 by use of the pressure regulator dial 66 to increase or decrease the air pressure in the pneumatic cylinders 38 which in turn controls nip force on the web material 26 between the nip roll 48 and the friction coated pacing roll 70. The user can read the air pressure on the pressure gauge 64 and turn the mid-driven infeed tension controlling system 12 on and off by use of the on/off switch 62. By creating two separate tension zones, one for printing and one for converting, the mid-driven infeed tension controlling system 12 improves color to color registration in steady state run tolerances, improves make ready times and waste factors and improves the register of products upon the starts and stops of the flexographic tag and label press 10 as well as facilitating roll changes and random material roll splices. The end result of utilizing the mid-driven infeed tension controlling system 12 in the flexographic tag and label press 10 is that the tags and labels produced by the flexographic tag and label press 10 are printed and die cut with tighter register tolerances with considerable lower waste factors.

Other possible applications of the mid-driven infeed tension controlling system 12 are (1) a combination mid-driven infeed or driven laminating station; (2) a non-driven laminating station; or (3) a driven infeed tension device.

Thus, artisans skilled in the art will appreciate that the mid-driven infeed tension controlling system 12 of the present invention as described herein can be employed advantageously to control the tension on the web material 26 in the printing/drying section 16 in an efficient and convenient manner. Therefore, it will be seen from the above that the invention described admirably achieves the objects of the invention. However, it will be appreciated that departures can be made by those skilled in the art without departing from the spirit and scope of the invention, which is limited only by the following claims.

Having thus described the invention, what is claimed is:

1. A flexographic tag and label press for processing a web material following a web path therethrough, comprising:

(a) a printing/drying section in the web path for providing color on the web material;

(b) a converting section in the web path downstream of said printing/drying section for cutting the web material to form tags or labels, the converting section having a driven mechanism; and (c) a mid-driven infeed tension control apparatus in the web path between said printing/drying section and said converting section for use in controlling tension in the web material passing through the printing/drying section, said mid-driven infeed tension control apparatus comprises:

(i) a driving mechanism drivingly engaged by said driven mechanism of said converting section, (ii) a pacing roll rotatable about an axis and drivingly engaged by said driving mechanism to rotate said pacing roll, (iii) a nip roll rotatable about an axis substantially parallel to the axis of said pacing roll, said nip roll being adjacent said pacing roll to create a nip therewith through which the web material passes, whereby said nip roll and said pacing roll exerting a force on the web material passing through the nip, and (iv) a mechanism to adjust the force on the web material passing through the nip thus controlling tension in the web material passing through said printing/drying section.

2. The flexographic tag and label press in accordance with claim 1, wherein said driving mechanism has a gear adjustably adapted to be drivingly engaged by said driven mechanism of said converting section.

3. The flexographic tag and label press in accordance with claim 1, wherein said driving mechanism is a swing gear assembly which includes a swing gear mounted on a swing gear mounting plate, whereby said swing gear mounting plate is adapted to be adjusted to move said swing gear into driving engagement with said driven mechanism of said converting section.

4. The flexographic tag and label press in accordance with claim 1, wherein said driving mechanism includes a pacing roll gear mounted on an end of said pacing roll about the axis thereof.

5. The flexographic tag and label press in accordance with claim 4, wherein said driving mechanism has an intermediate drive gear between said pacing roll gear and said driven mechanism of said converting section.

6. The flexographic tag and label press in accordance with claim 5, wherein said driving mechanism has an adjustable gear between said intermediate drive gear and said driven mechanism of said converting section, whereby said adjustable gear is adjustably adapted to be drivingly engaged by said driven mechanism.

7. The flexographic tag and label press in accordance with claim 1, wherein said mid-driven infeed tension control apparatus further comprising an idler roll spaced from the nip for guiding the web material into the nip.

8. The flexographic tag and label press in accordance with claim 1, wherein one of said nip roll and said pacing roll has a resilient outer surface for engaging the web material.

9. The flexographic tag and label press in accordance with claim 8, wherein the other of said nip roll and said pacing roll has a friction finish on an outer surface thereof for engaging the web material.

10. The flexographic tag and label press in accordance with claim 1, wherein said mechanism to adjust the force on the web material passing through the nip relatively moves said nip roll and said pacing roll.

11. The flexographic tag and label press in accordance with claim 10, wherein said nip roll is moved relative to said pacing roll.

12. The flexographic tag and label press in accordance with claim 11, wherein said mechanism to adjust the force on the web material passing through the nip includes at least one pneumatically actuated cylinder for moving said nip roll.

13. The flexographic tag and label press in accordance with claim 12, wherein air pressure to said at least one pneumatically actuated cylinder can be varied to adjust the force on the web material passing through the nip thus controlling tension in the web material passing through said printing/drying section.

14. The flexographic tag and label press in accordance with claim 1, further including a pair of spaced apart support plates between which said pacing roll and said nip roll are rotatably mounted.

15. The flexographic tag and label press in accordance with claim 14, wherein at least one of said pair of spaced apart support plates is mounted adjacent said converting section.

16. The flexographic tag and label press in accordance with claim 14, wherein at least a portion of said driving mechanism drivingly engaged by said driven mechanism of said converting section is mounted on one of said pair of spaced apart support plates.

17. A mid-driven infeed tension control apparatus for use between a printing/drying section and a converting section of a flexographic tag and label press for processing a web material, the converting section having a driven mechanism, the mid-driven infeed tension control apparatus comprises:

(a) a driving mechanism adapted to be drivingly engaged by the driven mechanism of the converting section of the flexographic tag and label press;

(b) a pacing roll rotatable about an axis and drivingly engaged by said driving mechanism to rotate said pacing roll;

(c) a nip roll rotatable about an axis substantially parallel to the axis of said pacing roll, said nip roll being adjacent said pacing roll to create a nip therewith through which the web material passes, whereby said nip roll and said pacing roll exerting a force on the web material passing through the nip; and (d) a mechanism to adjust the force on the web material passing through the nip thus controlling tension in the web material passing through the printing/drying section of the flexographic tag and label press.

18. The mid-driven infeed tension control apparatus in accordance with claim 17, wherein said driving mechanism has a gear adjustably adapted to be drivingly engaged by the driven mechanism of the converting section of the flexographic tag and label press.

19. The mid-driven infeed tension control apparatus in accordance with claim 17, wherein said driving mechanism is a swing gear assembly which includes a swing gear mounted on a swing gear mounting plate, whereby said swing gear mounting plate is adapted to be adjusted to move said swing gear into driving engagement with the driven mechanism of the converting section of the flexographic tag and label press.

20. The mid-driven infeed tension control apparatus in accordance with claim 17, wherein said driving mechanism includes a pacing roll gear mounted on an end of said pacing roll about the axis thereof.

21. The mid-driven infeed tension control apparatus in accordance with claim 20, wherein said driving mechanism has an intermediate drive gear between said pacing roll gear and the driven mechanism of the converting section of the flexographic tag and label press.

22. The mid-driven infeed tension control apparatus in accordance with claim 21, wherein said driving mechanism has an adjustable gear between said intermediate drive gear and the driven mechanism of the converting section of the flexographic tag and label press, whereby said adjustable a gear is adjustably adapted to be drivingly engaged by the driven mechanism.

23. The mid-driven infeed tension control apparatus in accordance with claim 17, further comprising an idler roll spaced from the nip for guiding the web material into the nip.

24. The mid-driven infeed tension control apparatus in accordance with claim 17, wherein one of said nip roll and said pacing roll has a resilient outer surface for engaging the web material.

25. The mid-driven infeed tension control apparatus in accordance with claim 24, wherein the other of said nip roll and said pacing roll has a friction finish on an outer surface thereof for engaging the web material.

26. The mid-driven infeed tension control apparatus in accordance with claim 17, wherein said mechanism to adjust the force on the web material passing through the nip relatively moves said nip roll and said pacing roll.

27. The mid-driven infeed tension control apparatus in accordance with claim 26, wherein said nip roll is moved relative to said pacing roll.

28. The mid-driven infeed tension control apparatus in accordance with claim 27, wherein said mechanism to adjust the force on the web material passing through the nip includes at least one pneumatically actuated cylinder for moving said nip roll.

29. The mid-driven infeed tension control apparatus in accordance with claim 28, wherein air pressure to said at least one pneumatically actuated cylinder can be varied to adjust the force on the web material passing through the nip thus controlling tension in the web material passing through the printing/drying section of the flexographic tag and label press.

30. The mid-driven infeed tension control apparatus in accordance with claim 17, further including a pair of spaced apart support plates between which said pacing roll and said nip roll are rotatably mounted.

31. The mid-driven infeed tension control apparatus in accordance with claim 30, wherein at least one of said pair of spaced apart support plates is adapted to be mounted adjacent the converting section of the flexographic tag and label press.

32. The mid-driven infeed tension control apparatus in accordance with claim 30, wherein at least a portion of said driving mechanism adapted to be drivingly engaged by the driven mechanism of the converting section of the flexographic tag and label press is mounted on one of said pair of spaced apart support plates.

33. A method for controlling tension in a web material passing through a flexographic tag and label press, which comprises the steps of:

(a) providing a flexographic tag and label press for processing the web material following a web path through the flexographic tag and label press, comprising:

(i) a printing/drying section in the web path for providing color on the web material, and (ii) a converting section in the web path downstream of said printing/drying section for cutting the web material to form tags or labels, the converting section having a driven mechanism;

(b) providing a mid-driven infeed tension control apparatus in the web path between said printing/drying section and said converting section for use in controlling tension in the web material passing through the printing/drying section, said mid-driven infeed tension control apparatus comprises:

(i) a driving mechanism drivingly engaged by said driven mechanism of said converting section, (ii) a pacing roll rotatable about an axis and drivingly engaged by said driving mechanism to rotate said pacing roll, (iii) a nip roll rotatable about an axis substantially parallel to the axis of said pacing roll, said nip roll being adjacent said pacing roll to create a nip therewith through which the web material passes, whereby said nip roll and said pacing roll exerting a force on the web material passing through the nip, and (iv) a mechanism to adjust the force on the web material passing through the nip thus controlling tension in the web material passing through said printing/drying section; and (c) adjusting the force adjusting mechanism of said mid-driven infeed tension control apparatus to adjust the force on the web material passing through the nip thus controlling tension in the web material passing through said printing/drying section.

34. The method for controlling tension in a web material in accordance with claim 33, wherein said driving mechanism has a gear adjustably adapted to be drivingly engaged by said driven mechanism of said converting section.

35. The method for controlling tension in a web material in accordance with claim 33, wherein said driving mechanism is a swing gear assembly which includes a swing gear mounted on a swing gear mounting plate, whereby said swing gear mounting plate is adapted to be adjusted to move said swing gear into driving engagement with said driven mechanism of said converting section.

36. The method for controlling tension in a web material in accordance with claim 33, wherein said driving mechanism has a pacing roll gear mounted on an end of said pacing roll about the axis thereof.

37. The method for controlling tension in a web material in accordance with claim 36, wherein said driving mechanism has an intermediate drive gear between said pacing roll gear and said driven mechanism of said converting section.

38. The method for controlling tension in a web material in accordance with claim 37, wherein said driving mechanism has an adjustable gear between said intermediate drive gear and said driven mechanism of said converting section, whereby said adjustable gear is adjustably adapted to be drivingly engaged by said driven mechanism.

39. The method for controlling tension in a web material in accordance with claim 33, wherein said mid-driven infeed tension control apparatus further comprising an idler roll spaced from the nip for guiding the web material into the nip.

40. The method for controlling tension in a web material in accordance with claim 33, wherein one of said nip roll and said pacing roll has a resilient outer surface for engaging the web material.

41. The method for controlling tension in a web material in accordance with claim 40, wherein the other of said nip roll and said pacing roll has a friction finish on an outer surface thereof for engaging the web material.

42. The method for controlling tension in a web material in accordance with claim 33, wherein said mechanism to adjust the force on the web material passing through the nip relatively moves said nip roll and said pacing roll.

43. The method for controlling tension in a web material in accordance with claim 42, wherein said nip roll is moved relative to said pacing roll.

44. The method for controlling tension in a web material in accordance with claim 43, wherein said mechanism to adjust the force on the web material passing through the nip includes at least one pneumatically actuated cylinder for moving said nip roll.

45. The method for controlling tension in a web material in accordance with claim 44, wherein air pressure to said at least one pneumatically actuated cylinder can be varied to adjust the force on the web material passing through the nip thus controlling tension in the web material passing through said printing/drying section.

46. The method for controlling tension in a web material in accordance with claim 33, further including a pair of spaced apart support plates between which said pacing roll and said nip roll are rotatably mounted.

47. The method for controlling tension in a web material in accordance with claim 46, wherein at least one of said pair of spaced apart support plates is mounted adjacent said converting section.

48. The method for controlling tension in a web material in accordance with claim 46, wherein at least a portion of said driving mechanism drivingly engaged by said driven mechanism of said converting section is mounted on one of said pair of spaced apart support plates.

* * * * *